US008505223B2

(12) United States Patent
Hem

(10) Patent No.: US 8,505,223 B2
(45) Date of Patent: Aug. 13, 2013

(54) HEATING DEVICE FOR THE IRONING TOP OF AN IRONING BOARD

(75) Inventor: Sudhana Hem, Mussolente (IT)

(73) Assignee: GIMI S.p.A., Monselice (IT)

( * ) Notice: Subject to any disclaimer, the term of this patent is extended or adjusted under 35 U.S.C. 154(b) by 110 days.

(21) Appl. No.: 13/317,505

(22) Filed: Oct. 20, 2011

(65) Prior Publication Data

US 2013/0097897 A1 Apr. 25, 2013

(51) Int. Cl.
*D06F 83/00* (2006.01)
*D06F 81/08* (2006.01)

(52) U.S. Cl.
USPC ..... 38/140

(58) Field of Classification Search
USPC ..... 38/97, 140; 219/245
See application file for complete search history.

(56) References Cited

U.S. PATENT DOCUMENTS

| | | | | |
|---|---|---|---|---|
| 1,342,864 | A * | 6/1920 | Nikonow | 219/249 |
| 2,249,110 | A | 7/1941 | Browning | |
| 2,282,300 | A * | 5/1942 | Place | 38/137 |
| 3,138,700 | A * | 6/1964 | Kleinsorge | 219/521 |
| 3,206,881 | A | 9/1965 | Kleinsorge | |
| 4,286,143 | A * | 8/1981 | Tadewald | 219/467.1 |
| 6,351,902 | B1 | 3/2002 | Yeung et al. | |

FOREIGN PATENT DOCUMENTS

| | | | |
|---|---|---|---|
| GB | 752 473 | A | 7/1956 |

* cited by examiner

*Primary Examiner* — Ismael Izaguirre
(74) *Attorney, Agent, or Firm* — Modiano & Associati; Daniel J. O'Byrne

(57) ABSTRACT

A heating device for the ironing top of an ironing board, comprising a flexible flat element, to be associated with a top of an ironing board, provided with heating elements arranged so as to affect at least part of at least one of its main surfaces. Advantageously, the device comprises elements for the quick and reversible fixing of the flexible flat element to an ironing top.

9 Claims, 4 Drawing Sheets

HEATING DEVICE FOR THE IRONING TOP OF AN IRONING BOARD

The present invention relates to a heating device for the ironing top of an ironing board.

BACKGROUND OF THE INVENTION

Nowadays there are many known heating devices for the ironing top of an ironing board.

Heating the ironing top rapidly evaporates the humidity that may penetrate the garment being ironed which is sometimes struck by a jet of steam or lightly sprayed with water by other means external to the iron, such as a spray bottle, an asperser, or other similar means.

Indeed, the steam, if emitted in excessive quantities, or if sprayed on a part of a garment being ironed that is far from the heat of the iron, cools and dampens or wets the garment being ironed in a way that is entirely undesired.

The systems for heating an ironing top are often of the electric type, and sometimes of the fluid type.

The known systems have the common characteristic of being integrated within the structure of the ironing top, or stably fixed to the top or bottom thereof.

The known systems, although effective, make the ironing board, meaning the object in its entirety comprising ironing top and a supporting frame which can generally be folded flat for minimal encumbrance, very heavy and inconvenient to transport.

Moreover, producing such an ironing board with the ironing top heating system integrated is much more complex and and expensive than making a normal ironing board.

Another drawback of the known heating devices is constituted by the fact that the heating layer is generally under the ironing top, i.e. under the plate-like element that forms the rigid support surface against which the iron is pressed to perform the ironing.

In this way the heating layer is actually located relatively far from the garment being ironed, and its efficiency is reduced by the interposition of layers with low thermal conductivity between the heating layer and the garment being ironed.

A further drawback of the known heating devices for an ironing top is constituted by the fact that if, as is generally the case, the ironing top is constituted by a plate-like element made of metal, and its supporting structure is also made of metal, then the ironing top itself and the parts of the frame that support it produce a thermal inertia that retains and diffuses the heat emitted by the heating means, thus wastefully dispersing it and also heating parts of the ironing board which may remain hot for a long time, making the manageability of the ironing board by a user problematic into the bargain.

SUMMARY OF THE INVENTION

The aim of the present invention is to provide a heating device for the ironing top of an ironing board, which is capable of overcoming the above-mentioned drawbacks of known types of heating devices for the ironing top of an ironing board.

Within this aim, an object of the invention is to provide a heating device for the ironing top of an ironing board which is lightweight and easy to install also on ironing boards of the known type.

Another object of the invention is to provide a device that is more effective and efficient than known types of heating devices.

Another object of the invention is to provide a heating device that has lower thermal dispersion than the known types of heating devices.

Another object of the invention is to provide a device the operation of which requires a limited energy expenditure.

Another object of the invention is to provide a heating device for the ironing top of an ironing board, that can be implemented using known systems and technologies, and at low cost.

This aim, as well as these and other objects which will become better apparent hereinafter, are achieved by a heating device for the top of an ironing board, characterized in that it comprises a flexible flat element, to be associated with an ironing top of an ironing board, said flexible flat element being provided with heating means, which are arranged so as to affect at least part of at least one of its main surfaces.

Advantageously, the device comprises means for the quick and reversible fixing of the flexible flat element to an ironing top of an ironing board.

BRIEF DESCRIPTION OF THE DRAWINGS

Further characteristics and advantages of the invention will become better apparent from the description of five preferred, but not exclusive, embodiments of the device according to the invention, illustrated by way of non-limiting example in the accompanying drawings, wherein.

DESCRIPTION OF THE PREFERRED EMBODIMENTS

Figure 1:
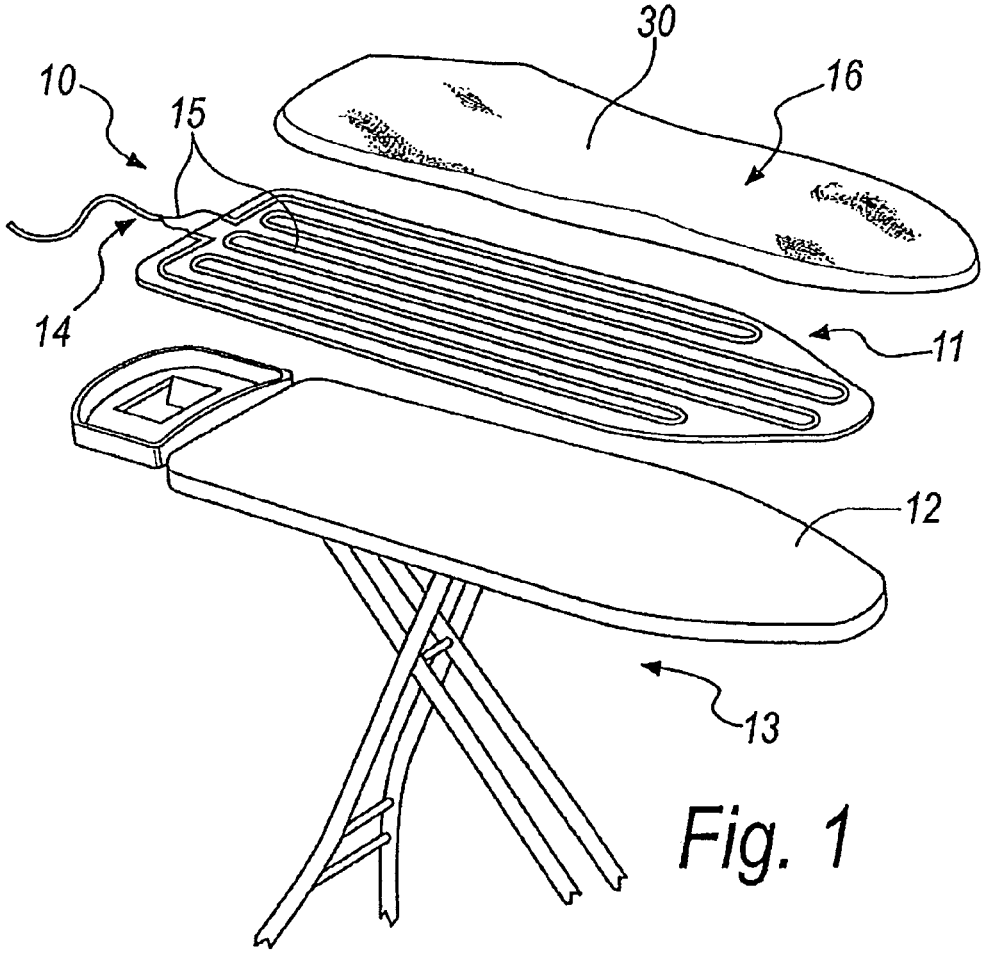
FIG. 1 is a partially exploded perspective view of the device according to the invention in a first embodiment thereof.
Figure 2:
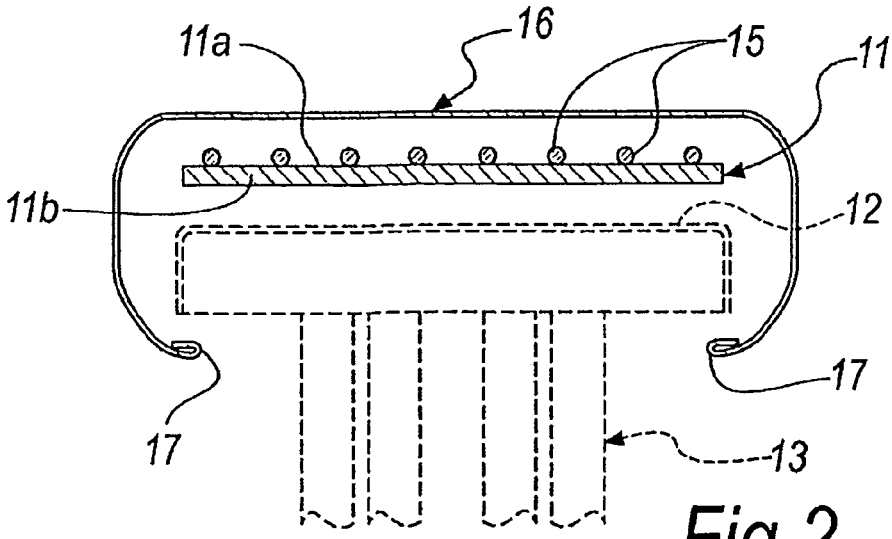
FIG. 2 is an exploded cross-sectional, schematic view of the device according to the invention in the first embodiment thereof.
Figure 3:
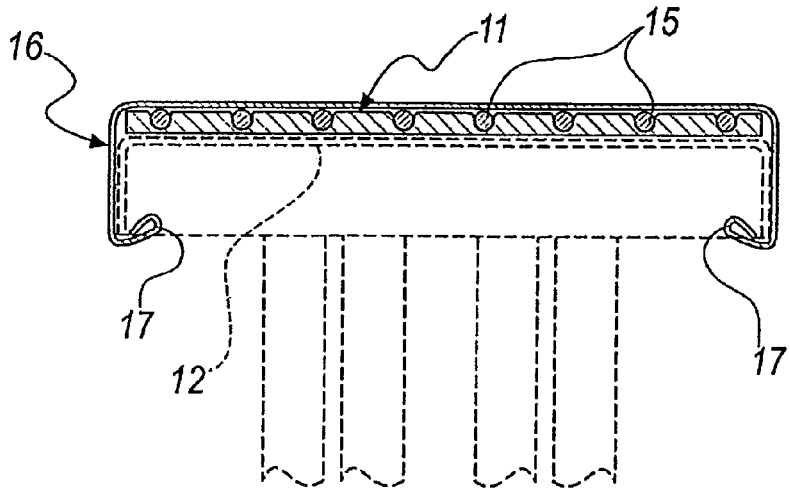
FIG. 3 is a cross-sectional view of the device according to the invention.

With reference to the figures, a heating device 10 for the ironing top of an ironing board, according to the invention, is indicated in its first embodiment with the reference numeral 10.

This heating device 10 comprises a flexible flat element 11, shaped to address an ironing top 12 of a generic ironing board 13.

In this first embodiment of the invention, the flexible flat element 11 is constituted by a flannel, i.e., by a sheet of plush cloth.

This flexible flat element 11 is provided with heating means 14, which are positioned so as to affect at least part of at least one of its main surfaces 11*a* and 11*b*.

In this first embodiment of the device 10, the heating means 14 are constituted by an electric heating cable 15, of a type that is known per se, distributed over the top surface, in a configuration of use, 11*a*.

The heating cable 15 is arranged for example in a coil as shown in FIG. 1.

In a different embodiment of the invention, instead of the heating cable there is a flat flexible resistive element, also of a type that is known per se.

It should be noted that the heating means 14 can also comprise all elements that are equivalent to the heating cable 15 and to the above-mentioned flat flexible resistive elements.

The device 10 according to the invention also comprises means for the quick and reversible fixing of the flexible flat element to an ironing board.

In the first embodiment of the invention, which is intended for the purposes of non-limiting example of the invention, the quick and reversible fixing means are constituted by a cover 16, provided with an elasticized border 17 adapted to arrange itself below the ironing top 12 and there to keep the cover 16 under tension and stabilise the position of the flat element 11 with the heating means 14.

In order to remove the heating device 10 it is sufficient to take hold of the cover 16 by the elasticized border 17, and stretch the border so as to be able to slip the cover 16 off the ironing top 12.

Figure 4:
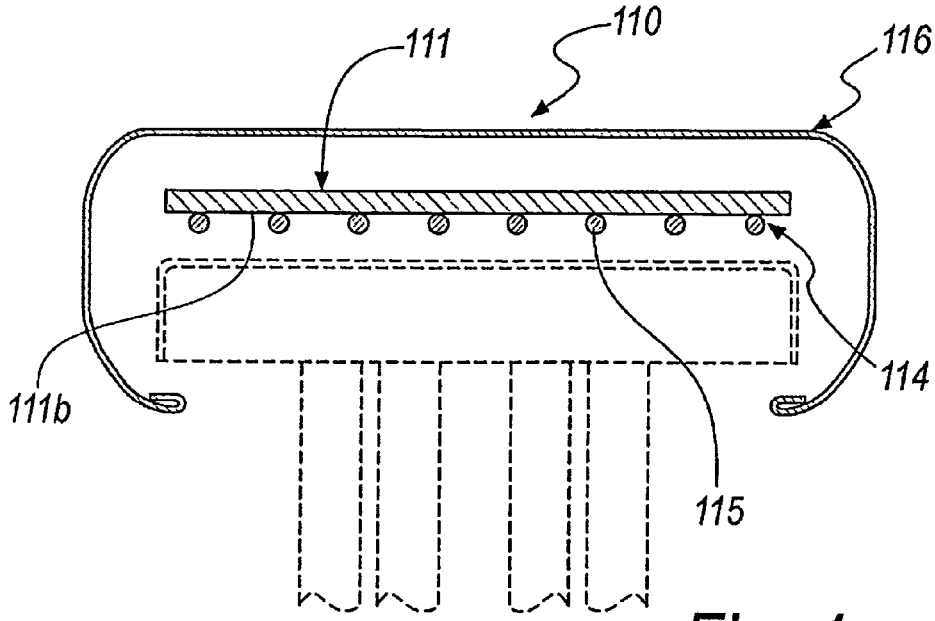
FIG. 4 is an exploded, cross-sectional, schematic view of the device in a second embodiment thereof.

In a second embodiment of the device according to the invention, shown schematically by the cross-section in FIG. 4 and indicated therein with the reference numeral 110, the heating means 114, i.e. for example the heating cable 115, are arranged on the lower surface 111*b* of the flexible flat element 111.

In this position the planarity of the ironing surface of the cover 116, in a configuration of use, is improved.

Figure 5:
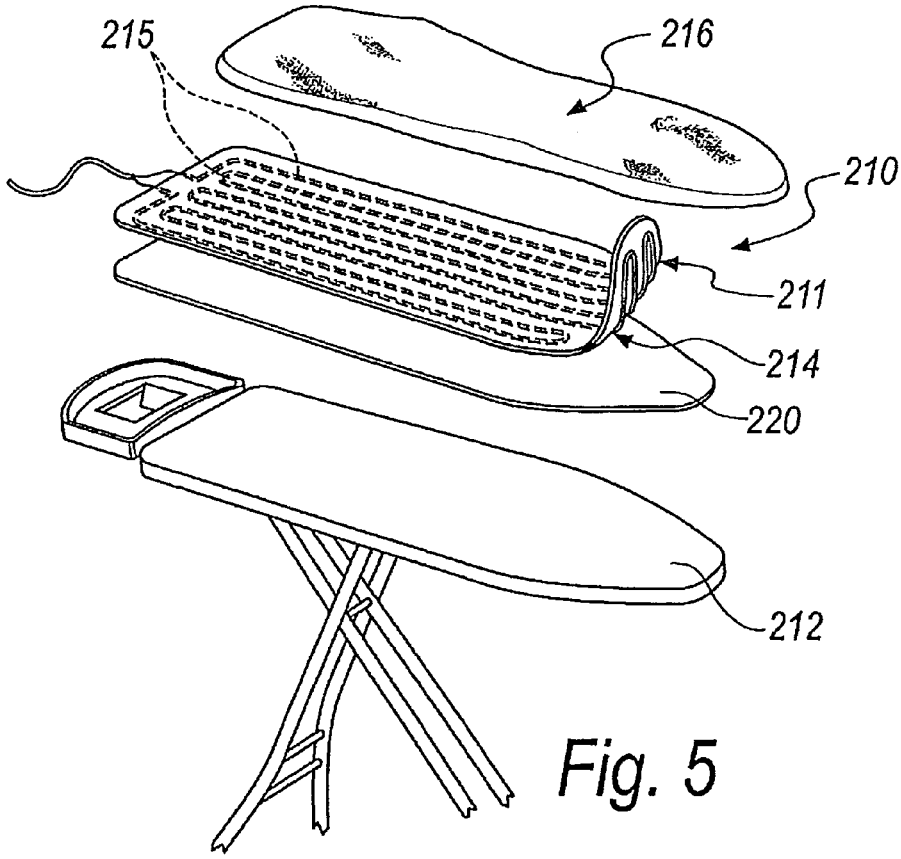
FIG. 5 is a partially exploded perspective view of the device according to the invention in a third embodiment thereof.
Figure 6:
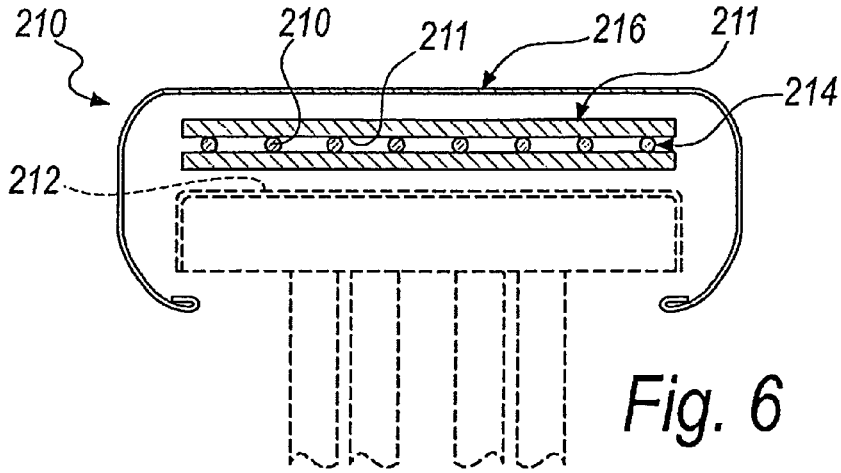
FIG. 6 is a cross-sectional, schematic view of the embodiment in FIG. 5.

FIGS. 5 and 6 show the heating device according to a third embodiment of the invention, indicated therein with the reference numeral 210.

In the third embodiment, the flexible flat element 211, which carries the heating means 214 on its lower surface 211*b*, is associated with a second flexible flat element 220, shaped likewise and adapted to be interposed between the first flat element 211 and the ironing top 212, so as to improve the thermal insulation of the heating means towards the ironing top itself, which is generally made of metal.

The heating cable 215, or other similar element, is therefore sandwiched between the two flexible flat elements, which, for example, can both be flannels.

It should be noted that the second flat element 220 can also be made from other, similar and equivalent materials, according to necessity and requirements.

The sandwich comprising the first flat element 211 and the second flat element 220 is held against the ironing top 212 by the cover 216.

Figure 7:
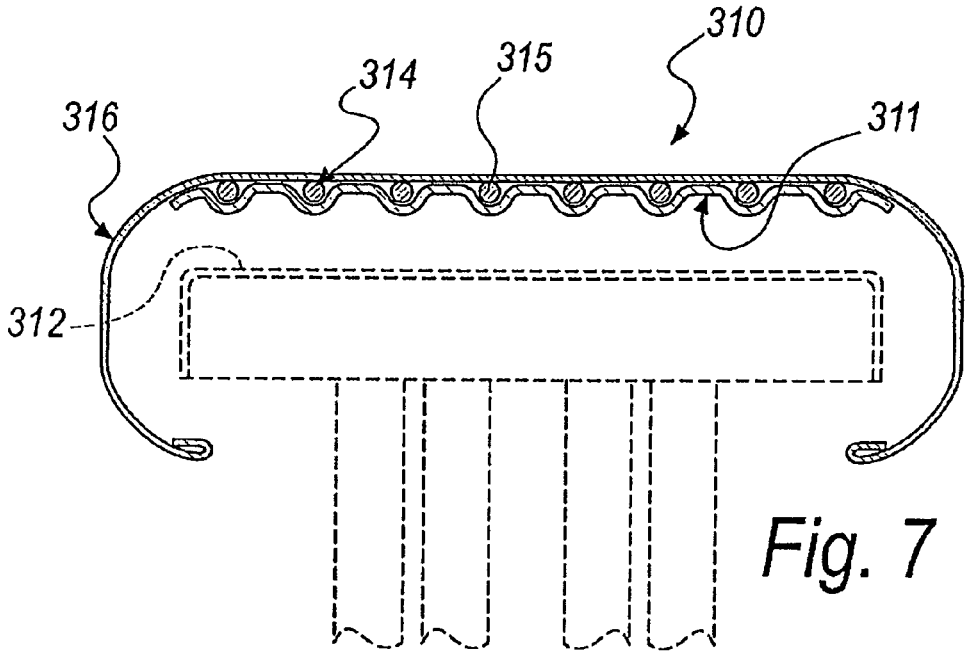
FIG. 7 is a cross-sectional view of a fourth embodiment of the device according to the invention.

In a fourth embodiment of the device according to the invention, indicated with the reference numeral 310 in FIG. 7, the flat element 311 with the heating means 314, i.e. for example the electric heating cable 315, is fixed inside the cover 316, i.e. on the surface designed to face the ironing top 312.

In this way, advantageously a user has to handle one element only, the cover 316, instead of two elements, as in the first embodiment of the invention, which provides the cover and one flannel, or three elements, as in the third embodiment of the invention which provides the cover and two flannels.

Figure 8:
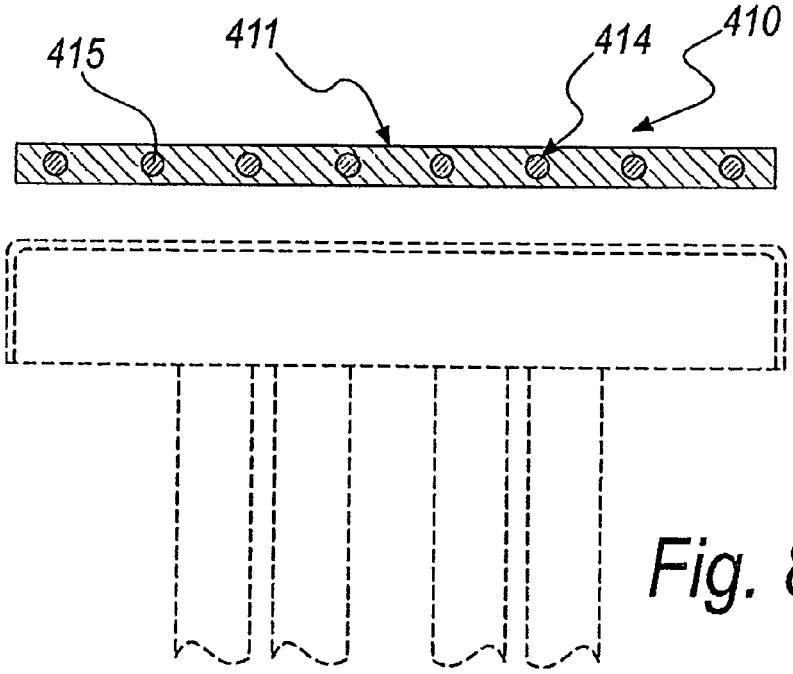
FIG. 8 is a cross-sectional view of a fifth embodiment of the device according to the invention.

In a fifth embodiment of the heating device according to the invention, which is schematically shown in FIG. 8 and indicated therein with the reference numeral 410, the heating means 414 are integrated in the flexible flat element 411, which for example can be made of plastic material molded or overmolded on the heating cable 415 or other similar and equivalent heating element.

It should be noted that in general the heating means 14, 114, 214 and 314 can be fixed to the flexible flat element that supports them by at least one method selected among sewing, hot-pressing, ultrasonic welding, adhesive bonding and the like.

The heating means are preferably of the low energy consumption type.

In practice it has been found that the invention fully achieves the intended aim and objects.

In particular, with the invention a heating device is provided for the ironing top of an ironing board, which is lightweight and easy to install also on ironing boards of the known type, thanks to the ability of the cover 16, which is provided with an elasticized border 17, to adapt to ironing tops of different dimensions, and by thanks to the distribution of the electric heating cable 15, and of the heating means 14 in general, which are distributed on the flexible flat element 11 so as to achieve a heating that is as uniform as possible over all the ironing surface 30.

Moreover, with the invention a device is provided that is more effective and efficient than known heating devices, thanks to the proximity of the heating means 14 to the ironing surface 30, and therefore having a lower dispersion of heat than known heating devices, and thanks to the adoption of heating means 14 with low energy consumption.

Furthermore, with the invention a device is provided the operation of which requires only simple instruction, and which facilitates the ironing process by preventing the humidity produced by the iron from stagnating in the cover, in the flannel or, worse, in the garment being ironed.

Furthermore, with the invention a device is provided for heating the ironing top of an ironing board, that can be implemented using known systems and technologies, and at low cost.

The invention, thus conceived, is susceptible of numerous modifications and variations, all of which are within the scope of the appended claims. Moreover, all the details may be substituted by other, technically equivalent elements.

In practice the materials employed, as well as the contingent dimensions and shapes, may be any according to requirements and to the state of the art.

What is claimed is:

1. A heating device for the top of an ironing board, comprising a flexible flat element, to be associated with a top of an ironing board, provided with heating means arranged so as to affect at least part of at least one of its main surfaces, and further comprising means for the quick and reversible fixing of said flexible flat element to an ironing top.

2. The heating device according to claim 1, wherein said flexible flat element is constituted by a flannel.

3. The heating device according to claim 1, wherein said heating means are constituted by an electric heating cable, or by a flat flexible resistive element.

4. The heating device according to claim 1, wherein said quick and reversible fixing means are constituted by a cover provided with an elasticized border adapted to be arranged below the ironing top.

5. The heating device according to claim 1, wherein a second flexible flat element is associated with the flexible flat element that supports the heating means, is shaped likewise and is adapted to be arranged so that the heating means are sandwiched between the two flexible flat elements.

6. The heating device according to claim 1, wherein said flat element with the heating means is fixed inside a cover.

7. The heating device according to claim 1, wherein the heating means are integrated in the flexible flat element.

8. The heating device according to claim 1, wherein said heating means are fixed to the flexible flat element that supports them by at least one method selected among sewing, hot-pressing, ultrasonic welding, adhesive bonding.

9. The heating device according to claim 1, wherein the heating means are of the low-consumption type.

* * * * *